US010870559B2

(12) United States Patent
Cao et al.

(10) Patent No.: US 10,870,559 B2
(45) Date of Patent: Dec. 22, 2020

(54) APPARATUS AND METHOD FOR MEASURING ROTATIONAL ANGLE OF SINKING PLATFORM

(71) Applicants: China University of Mining and Technology, Jiangsu (CN); XUZHOU COAL MINE SAFETY EQUIPMENT MANUFACTURE CO., LTD, Jiang-su (CN)

(72) Inventors: Guohua Cao, Jiangsu (CN); Yandong Wang, Jiangsu (CN); Zhencai Zhu, Jiangsu (CN); Weihong Peng, Jiangsu (CN); Gang Shen, Jiangsu (CN); Shanzeng Liu, Jiangsu (CN); Chunli Hua, Jiangsu (CN); Zhenhua Jiang, Jiangsu (CN); Xuan Dong, Jiangsu (CN)

(73) Assignees: CHINA UNIVERSITY OF MINING AND TECHNOLOGY, Xuzhou (CN); XUZHOU COAL MINE SAFETY EQUIPMENT MANUFACTURE CO., LTD, Xuzhou (CN)

( * ) Notice: Subject to any disclaimer, the term of this patent is extended or adjusted under 35 U.S.C. 154(b) by 249 days.

(21) Appl. No.: 16/075,945

(22) PCT Filed: Nov. 13, 2017

(86) PCT No.: PCT/CN2017/110687
§ 371 (c)(1),
(2) Date: Aug. 6, 2018

(87) PCT Pub. No.: WO2018/107933
PCT Pub. Date: Jun. 21, 2018

(65) Prior Publication Data
US 2019/0337773 A1 Nov. 7, 2019

(30) Foreign Application Priority Data
Dec. 15, 2016 (CN) ..... 2016 1 1162137

(51) Int. Cl.
*B66C 13/16* (2006.01)
*B66C 13/46* (2006.01)

(52) U.S. Cl.
CPC ..... *B66C 13/16* (2013.01); *B66C 13/46* (2013.01)

(58) Field of Classification Search
CPC ..... B66C 13/46; B66C 13/06; B66C 13/063
See application file for complete search history.

(56) References Cited

U.S. PATENT DOCUMENTS 5,806,696 A * 9/1998 Hytonen ..... B66C 13/54 212/270
6,081,292 A * 6/2000 Lanigan, Jr. ..... B66C 13/46 114/264

(Continued)

FOREIGN PATENT DOCUMENTS

CN 101643184 A 2/2010
CN 102602838 7/2012

(Continued)

OTHER PUBLICATIONS

International Search Report and Written Opinion issued in corresponding application No. PCT/CN2017/110687 dated Feb. 24, 2018.

(Continued)

*Primary Examiner* — Michael A Riegelman
(74) *Attorney, Agent, or Firm* — Foley & Lardner LLP

(57) ABSTRACT

An apparatus and a method for measuring a rotational angle of a sinking platform. The apparatus includes a sinking platform being a subject to be measured, suspension ropes and guide ropes connected to the sinking platform, a carriage (Continued)

assembled on the guide ropes, a gyroscope and a gyroscope signal radio transmitter mounted at an upper end of the carriage, and a tilt angle sensor and a radio signal reception processor mounted on the sinking platform. During running of the carriage, the gyroscope keeps measuring a pose of the carriage, and a measured signal is transmitted to the radio transmitter in a wired manner. The radio transmitter transmits a pose signal of the carriage during running to the radio signal reception processor in a wireless manner. A turning angle of the sinking platform in the y direction is accurately obtained by subtracting a pose of the carriage being located at the top of the guide ropes from a pose of the carriage being located at the bottom of the guide ropes. Tilt angles of the sinking platform in the x direction and the z direction can be measured in real time by using the tilt angle sensor. Therefore, rotational angles of the sinking platform in three directions can be conveniently and accurately measured.

3 Claims, 2 Drawing Sheets

(56) References Cited

U.S. PATENT DOCUMENTS 6,135,301 A * 10/2000 Monzen ..... B66C 13/06 212/272
6,250,486 B1 * 6/2001 Enoki ..... B66C 11/16 212/270
6,962,091 B2 * 11/2005 Lukas ..... B66C 13/063 212/276
7,150,366 B1 * 12/2006 Zakula, Sr. ..... B66C 13/06 212/272
9,321,614 B2 * 4/2016 Moran ..... B66C 13/063
9,422,139 B1 * 8/2016 Bialkowski ..... B64C 39/024
2005/0103738 A1 * 5/2005 Recktenwald ..... B66C 13/063 212/275
2005/0242052 A1 * 11/2005 O'Connor ..... B66C 19/007 212/344
2008/0021592 A1 1/2008 Recktenwald et al.
2011/0272376 A1 * 11/2011 Jung ..... B66C 11/08 212/276
2012/0168397 A1 * 7/2012 Lim ..... B66C 13/063 212/273
2014/0224755 A1 * 8/2014 Eriksson ..... G01C 9/08 212/273
2015/0291391 A1 * 10/2015 Zhu ..... B66B 5/28 187/347
2015/0353329 A1 * 12/2015 Lin ..... B66C 13/16 33/333
2016/0362280 A1 * 12/2016 Savaresi ..... B66C 13/063
2018/0265339 A1 * 9/2018 Zhu ..... B66C 13/08
2019/0337773 A1 * 11/2019 Cao ..... B66C 13/46
2019/0375615 A1 * 12/2019 Markwell ..... B66C 13/40

FOREIGN PATENT DOCUMENTS

CN 202499676 U 10/2012
CN 102495233 6/2013
CN 103359645 10/2013
CN 104386583 A 3/2015
CN 105934401 A 9/2016
CN 106744332 A 5/2017

OTHER PUBLICATIONS

First Search Report issued on Application No. CN201611162137 dated Sep. 26, 2017.

* cited by examiner

APPARATUS AND METHOD FOR MEASURING ROTATIONAL ANGLE OF SINKING PLATFORM

BACKGROUND OF THE INVENTION

Technical Field

The present invention relates to an apparatus and a method for measuring a rotational angle of a sinking platform, which are particularly applicable to measurement of a longitudinal rotation angle of a sinking platform in a construction shaft.

Background

A steel wire rope has a mechanical property of axial-torsional coupling. That is, longitudinal tension in the steel wire rope makes the steel wire rope generate axial torque, and at the same time axial torque in the steel wire rope makes the steel wire rope generate longitudinal tension. Meanwhile, longitudinal tension causes different longitudinal torque in steel wires in the steel wire rope because the steel wires turn in different directions. Therefore, during the selection of suspension ropes for a sinking platform, half of the suspension ropes are left-hand lay ropes and the other half of the suspension ropes are right-hand lay rope, so that torque generated when the ropes have consistent tension can counteract each other. In an actual working condition, suspension steel wire ropes cannot have identical tension, and a sum of torque generated in the steel wire ropes is not zero. As a result, the sinking platform turns. When the sinking platform has a relatively large turning angle, the running of a kibble on the sinking platform is severely affected, and it cannot be determined without a reference point whether the sinking platform is turning when the sinking platform is downhole. When four steel wire ropes are released by different lengths, the sinking platform tilts, and the safety of workers and equipment on the sinking platform is severely affected. Therefore, an apparatus for measuring a rotational angle of a sinking platform is invented to conveniently measure a rotational direction, a rotational angle, and a tilt angle of the sinking platform.

SUMMARY OF THE INVENTION

Technical problem: The objective of the present invention is to resolve the problem that a rotational direction and a rotational angle of a sinking platform cannot be measured. An apparatus and a method for measuring a rotational angle of a sinking platform that have simple mounting and accurate measurement results are provided.

Technical solution: An apparatus for measuring a rotational angle of a sinking platform in the present invention includes a sinking platform being a subject to be measured and a plurality of suspension ropes and guide ropes connected to the sinking platform and used to suspend and elevate the sinking platform, where a carriage used to guide a hoisting container is assembled on two guide ropes, a gyroscope and a gyroscope signal radio transmitter are fixedly mounted at an upper end of the carriage, a measured signal of the gyroscope is transmitted to the radio transmitter in a wired manner, a tilt angle sensor and a radio signal reception processor are disposed on the sinking platform, and the radio signal reception processor receives a signal of the tilt angle sensor in a wired manner and processes the signal, or receives a signal of the radio transmitter in a wireless manner and processes the signal.

There are two suspension ropes, and there are two guide ropes.

Connection positions between two guide ropes assembled on a carriage and a head sheave at the top are set to be A and B, and connection positions between the two guide ropes and a sinking platform at the bottom are set to be a and b;

when the sinking platform is not turned, a line segment AB between the positions A and B is parallel to a line segment ab between the positions a and b;

after the sinking platform is turned in the y direction, an included angle between the line segment ab and the line segment AB is a turning angle of the sinking platform in the y direction;

when the carriage is at the top, the top of the carriage is parallel to the line segment AB;

when the carriage runs to the sinking platform, the top of the carriage is parallel to the line segment ab;

during running of the carriage, a pose of the carriage is measured in real time by using a gyroscope fixed at the top of the carriage, and a measured signal is transmitted to a radio transmitter in a wired manner; and after the carriage runs to reach the sinking platform, a radio transmitter transmits a pose signal of the carriage during running to a radio signal reception processor in a wireless manner, and the turning angle of the sinking platform in the y direction can be accurately obtained by subtracting a pose of the carriage being located at the top of the guide ropes from a pose of the carriage being located at the bottom of the guide ropes; and tilt angle information of the sinking platform in the x direction and the z direction is measured in real time by using a tilt angle sensor, and a measured signal is transmitted to the radio signal reception processor in a wired manner, to measure a rotational angle of the sinking platform.

Beneficial effects: The measurement apparatus of the present invention has a simple structure and convenient mounting. The turning angle of the sinking platform in the y direction can be accurately obtained by subtracting the pose of the carriage being located at the top of the guide ropes from the pose of the carriage being located at the bottom of the guide ropes. Tilt angles of the sinking platform in the x direction and the z direction can be measured in real time by using the tilt angle sensor. Rotational angles of the sinking platform in three directions can be conveniently and accurately measured, and the effect of measuring the sinking platform is desirable.

In the figures: 1—sinking platform, 2—suspension rope, 3—guide rope, 4—carriage, 5—gyroscope, 6—radio transmitter, 7—tilt angle sensor, and 8—radio signal reception processor.

Figure 2:
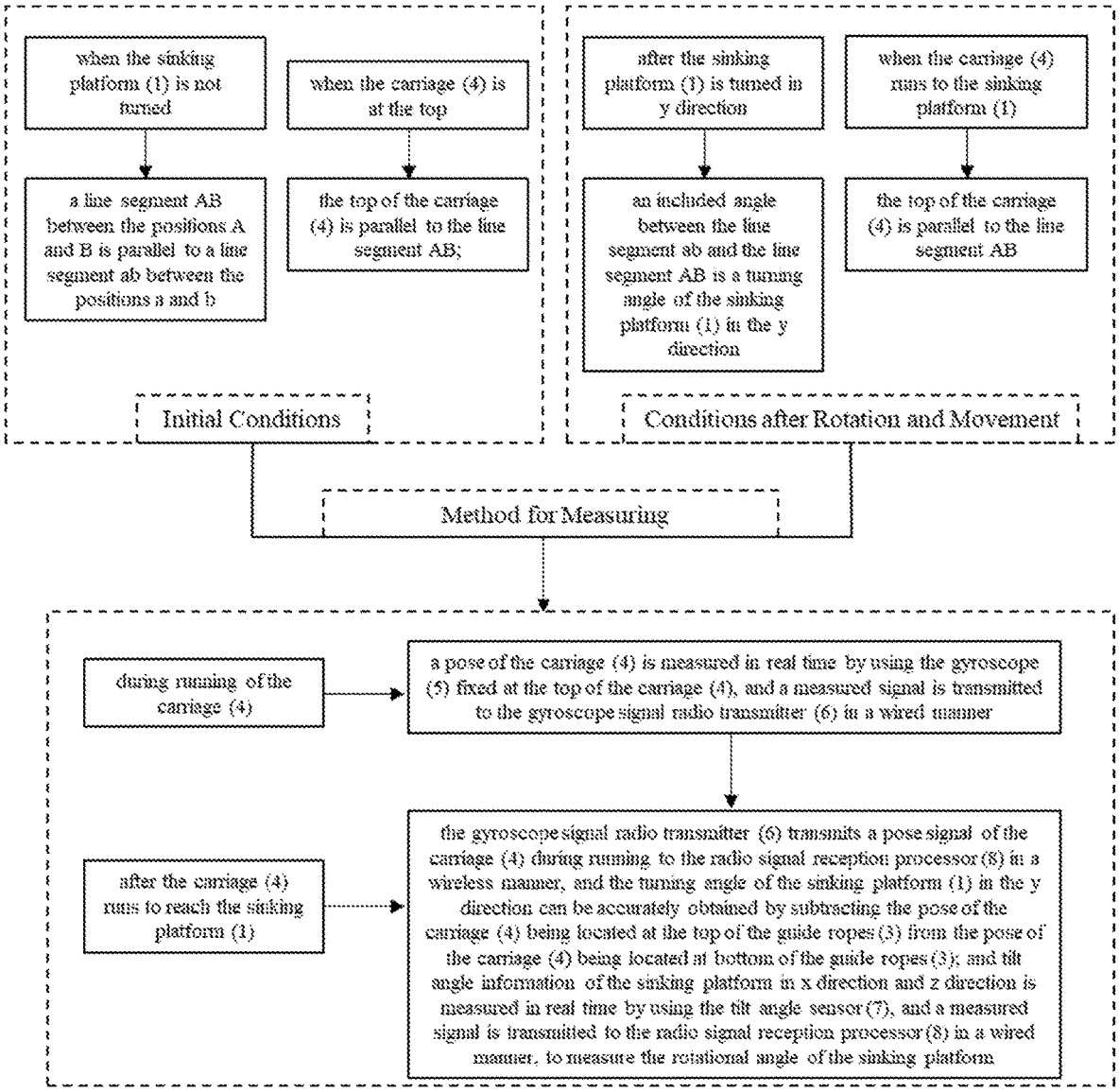

FIG. 2 shows a flow diagram showing a method for measuring the rotational angle of the sinking platform in accordance to an example embodiment.

DETAILED DESCRIPTION OF EMBODIMENTS

Figure 1:
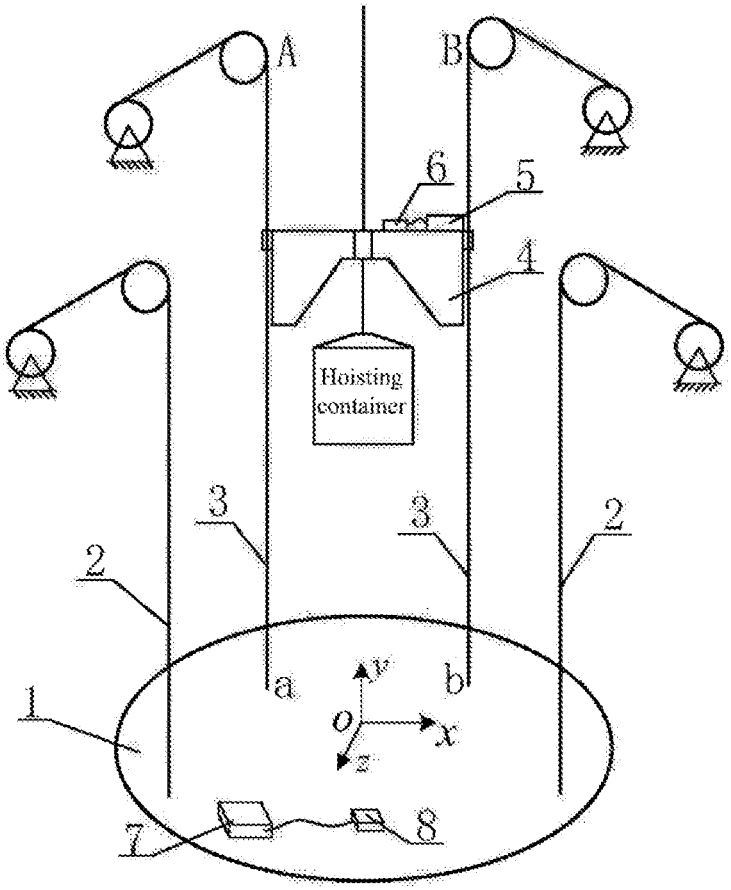
FIG. 1 is a schematic diagram of a system for measuring a rotational angle of a sinking platform according to the present invention.

One embodiment of the present invention is further described below with reference to the accompanying drawings:

As shown in FIG. 1, an apparatus for measuring a rotational angle of a sinking platform in the present invention includes a sinking platform 1 being a subject to be measured and a plurality of suspension ropes 2 and guide ropes 3 connected to the sinking platform 1 and used to suspend and elevate the sinking platform 1. A carriage 4 used to guide a hoisting container is assembled on two guide ropes 3. A gyroscope 5 and a gyroscope signal radio transmitter 6 are fixedly mounted at an upper end of the carriage 4. A measured signal of the gyroscope 5 is transmitted to the radio transmitter 6 in a wired manner. A tilt angle sensor 7 and a radio signal reception processor 8 are disposed on the sinking platform 1. The radio signal reception processor 8 receives a signal of the tilt angle sensor 7 in a wired manner and processes the signal, or receives a signal of the radio transmitter 6 in a wireless manner and processes the signal.

There are two suspension ropes 2, and there are two guide ropes 3.

In a method for measuring a rotational angle of a sinking platform in the present invention, connection positions between two guide ropes 3 assembled on a carriage 4 and a head sheave at the top are first set to be A and B, and connection positions between the two guide ropes 3 and a sinking platform 1 at the bottom are set to be a and b;

when the sinking platform 1 is not turned, a line segment AB between the positions A and B is parallel to a line segment ab between the positions a and b;

after the sinking platform 1 is turned in the y direction, an included angle between the line segment ab and the line segment AB is a turning angle of the sinking platform 1 in the y direction;

when the carriage 4 is at the top, the top of the carriage 4 is parallel to the line segment AB;

when the carriage 4 runs to the sinking platform 1, the top of the carriage 4 is parallel to the line segment ab;

during running of the carriage 4, a pose of the carriage 4 is measured in real time by using a gyroscope 5 fixed at the top of the carriage 4, and a measured signal is transmitted to a radio transmitter 6 in a wired manner; and after the carriage 4 runs to reach the sinking platform 1, the radio transmitter 6 transmits a pose signal of the carriage 4 during running to a radio signal reception processor 6 in a wireless manner, and the turning angle of the sinking platform 1 in the y direction can be accurately obtained by subtracting a pose of the carriage 4 being located at the top of the guide ropes 3 from a pose of the carriage 4 being located at the bottom of the guide ropes 3; and tilt angle information of the sinking platform in the x direction and the z direction is measured in real time by using a tilt angle sensor 7, and a measured signal is transmitted to the radio signal reception processor (6) in a wired manner, to measure a rotational angle of the sinking platform.

The four steel wire ropes of the sinking platform 1 are suspended in a shaft for running up and down. All the steel wire ropes include two types, that is, the suspension ropes 2 that are specially used for suspending the sinking platform and the guide ropes 3 that can be used to suspend the sinking platform 2 and can also be used as a running guide rail for a hoisting container. The carriage 4 is used as a guiding apparatus for the hoisting container and is kept assembled on the two guide ropes 3, so that the carriage 4 keeps running along the guide ropes 3. Connection points at the top of the two guide ropes 3 are denoted as A and B, and connection points between the bottom and the sinking platform 1 are denoted as a and b. When the sinking platform is not turned, the line segment AB and the line segment ab are kept in parallel. After the sinking platform is turned, the included angle between the line segment ab and the line segment AB is the turning angle of the sinking platform along the y axis. When the carriage 4 is located at the top of the guide ropes 3, the top of the carriage 4 is parallel to the line segment AB. During running of the carriage 4, the gyroscope 5 fixed at the top of the carriage 4 keeps recording a turning pose of the carriage 4, and a measured signal is transmitted to the radio transmitter 6 in a wired manner. When the carriage 4 runs to the sinking platform 1, the radio transmitter 6 transmits the pose signal of the carriage 4 during running to the radio signal reception processor 8 in a wireless manner. The turning angle of the sinking platform 1 along the y axis can be accurately obtained by subtracting the pose of the carriage 4 being located at the top of the guide ropes 3 from the pose of the carriage 4 being located at the bottom of the guide ropes 3. Tilt angles of the sinking platform in the x direction and the z direction can be measured in real time by using the tilt angle sensor 7, and a measured signal is transmitted to the radio signal reception processor 6 in a wired manner.

What is claimed is:

1. An apparatus for measuring a rotational angle of a sinking platform, comprising the sinking platform (1) being a subject to be measured and a plurality of suspension ropes (2) and two guide ropes (3) connected to the sinking platform (1) and used to suspend and elevate the sinking platform (1), wherein a carriage (4) used to guide a hoisting container is assembled on two guide ropes (3), a gyroscope (5) and a gyroscope signal radio transmitter (6) are fixedly mounted at an upper end of the carriage (4), a measured signal of the gyroscope (5) is transmitted to the gyroscope signal radio transmitter (6) in a wired manner, a tilt angle sensor (7) and a radio signal reception processor (8) are disposed on the sinking platform (1), and the radio signal reception processor (8) receives a signal of the tilt angle sensor (7) in a wired manner and processes the signal, or receives a signal of the gyroscope signal radio transmitter (6) in a wireless manner and processes the signal.

2. The apparatus for measuring the rotational angle of the sinking platform according to claim 1, wherein there are two suspension ropes (2), and there are two guide ropes (3).

3. A method for measuring the rotational angle of the sinking platform using the apparatus according to claim 1, wherein connection positions between two guide ropes (3) assembled on the carriage (4) and a head sheave are set to be A and B, and connection positions between the two guide ropes (3) and the sinking platform (1) are set to be a and b;

when the sinking platform (1) is not turned, a line segment AB between the positions A and B is parallel to a line segment ab between the positions a and b;

after the sinking platform (1) is turned in y direction, an included angle between the line segment ab and the line segment AB is a turning angle of the sinking platform (1) in the y direction;

when the carriage (4) is at the top, the top of the carriage (4) is parallel to the line segment AB;

when the carriage (4) runs to the sinking platform (1), the top of the carriage (4) is parallel to the line segment ab;

during running of the carriage (4), a pose of the carriage (4) is measured in real time by using the gyroscope (5) fixed at the top of the carriage (4), and a measured signal is transmitted to the gyroscope signal radio transmitter (6) in a wired manner; and after the carriage (4) runs to reach the sinking platform (1), the gyroscope signal radio transmitter (6) transmits a pose signal of the carriage (4) during running to the radio signal reception processor (8) in a wireless manner, and the turning angle of the sinking platform (1) in the y direction can be accurately obtained by subtracting the pose of the carriage (4) being located at the top of the guide ropes (3) from the pose of the carriage (4) being located at bottom of the guide ropes (3); and tilt angle information of the sinking platform in x direction and z direction is measured in real time by using the tilt angle sensor (7), and a measured signal is transmitted to the radio signal reception processor (8) in a wired manner, to measure the rotational angle of the sinking platform.

* * * * *